US010534310B2

(12) United States Patent
Sakuda et al.

(10) Patent No.: US 10,534,310 B2
(45) Date of Patent: Jan. 14, 2020

(54) CLEANING BLADE

(71) Applicant: Sumitomo Riko Company Limited, Aichi (JP)

(72) Inventors: Manabu Sakuda, Aichi (JP); Satoshi Endo, Aichi (JP); Kazushi Yamaguchi, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 16/420,209

(22) Filed: May 23, 2019

(65) Prior Publication Data

US 2019/0278212 A1 Sep. 12, 2019

Related U.S. Application Data

(63) Continuation of application No. PCT/JP2017/034997, filed on Sep. 27, 2017.

(30) Foreign Application Priority Data

Jan. 30, 2017 (JP) ..... 2017-014321

(51) Int. Cl.
*G03G 21/10* (2006.01)
*G03G 21/00* (2006.01)

(52) U.S. Cl.
CPC . *G03G 21/0017* (2013.01); *G03G 2221/0005* (2013.01)

(58) Field of Classification Search
CPC ..... G03G 21/0011; G03G 21/0017; G03G 2221/0005
See application file for complete search history.

(56) References Cited

U.S. PATENT DOCUMENTS

2016/0004207 A1* 1/2016 Sakaguchi ..... G03G 21/0017 399/350
2018/0275595 A1* 9/2018 Nimura ..... G03G 21/0017

FOREIGN PATENT DOCUMENTS

JP 2006243235 9/2006

OTHER PUBLICATIONS

"International Search Report (Form PCT/ISA/210) of PCT/JP2017/034997," dated Dec. 19, 2017, with English translation thereof, pp. 1-6.

* cited by examiner

*Primary Examiner* — Sophia S Chen
(74) *Attorney, Agent, or Firm* — JCIPRNET

(57) ABSTRACT

The present disclosure provides a cleaning blade capable of improving chipping resistance. A cleaning blade includes a blade part made of polyurethane and having an edge that comes in slidable contact with a mating part. The edge includes: a base material containing polyurethane; an impregnated layer containing polyurethane in the base material and a cured acrylic product and present from the surface through to the inside of the base material; and a particle layer containing particles supported by the surface of the base material. The average particle diameter of the particles is between 3 nm and 100 nm, inclusive. The thickness of the impregnated layer is 30 nm or greater and less than 1000 nm. The edge has an area ratio of the particle layer to the impregnated layer that is between 5% and 30%, inclusive in a cross section perpendicular to the surface of the base material.

1 Claim, 2 Drawing Sheets

CLEANING BLADE

CROSS-REFERENCE TO RELATED APPLICATIONS

This application is a continuation application of International Application number PCT/JP2017/034997, filed on Sep. 27, 2017, which claims the priority benefit of Japan Patent Application No. 2017-014321, filed on Jan. 30, 2017. The entirety of each of the above-mentioned patent applications is hereby incorporated by reference herein and made a part of this specification.

BACKGROUND

Technical Field

The present disclosure relates to a cleaning blade and a method of manufacturing the same.

Background Art

Conventionally, in an electrophotographic apparatus, a cleaning blade for cleaning a surface of a mating member such as an image carrier like photoreceptor, or an intermediate transfer belt is used. A cleaning blade includes a blade part having an edge that is brought into sliding contact with a mating member. When the edge of the blade part is pressed against a surface of the mating member, residual toner on the surface of the mating member that moves along the surface is scraped off.

As this type of cleaning blade, for example, a cleaning blade in which about tens of micrometers to hundreds of micrometers of the blade part are impregnated with an acrylate and then cured to form an impregnated layer on an edge thereof is known.

Further, preceding Patent Literature 1 (Japanese Laid-Open No. 2006-243235) discloses a cleaning blade having a particle layer formed by attaching fine particles to an end portion thereof including a blade edge that comes into contact with a surface of a photoreceptor and then causing the attached fine particles to be impregnated with a liquid adhesive.

However, the conventional technology has the following problems. An edge of a cleaning blade tends to be chipped due to friction caused by being in sliding contact with a mating member. Conventionally known cleaning blades are cleaning blades in which chipping due to this sliding contact is intended to be inhibited by forming an impregnated layer on the edge to reduce friction on the surface.

However, in recent years, there has been a demand for enhancing durability in an image forming device, and along with this, there is more than ever demand for better durability with respect to chipping also in the cleaning blade. In other words, simply forming an impregnated layer on the edge is not sufficient for the chipping resistance demanded in recent years and further enhancement in the chipping resistance is desired.

SUMMARY OF DISCLOSURE

The present disclosure has been made in view of the above-described background, and provides a cleaning blade in which chipping resistance can be enhanced.

One aspect of the present disclosure is a cleaning blade used to remove residual toner remaining on a surface of a mating member in an electrophotographic apparatus, and the cleaning blade includes a blade part made of polyurethane including an edge configured to be brought into sliding contact with the mating member, in which the edge has a base material containing polyurethane, an impregnated layer present from a surface of the base material to an inside of the base material and containing the polyurethane of the base material and an acrylic cured product, and a particle layer containing particles held on the surface of the base material, an average particle diameter of the particles is 3 nm or greater and 100 nm or less, a thickness of the impregnated layer is 30 nm or greater and less than 1000 nm, and an area ratio of the particle layer to the impregnated layer is 5% or higher and 30% or less in a cross-sectional view perpendicular to the surface of the base material.

Another aspect of the present disclosure is a method of manufacturing the cleaning blade, and the method of manufacturing the cleaning blade includes applying an impregnating solution containing an acrylic curable material and particles onto a surface of a base material containing polyurethane, forming an impregnated layer containing an acrylic cured product formed by curing the acrylic curable material and the polyurethane of the base material by causing the acrylic curable material to be impregnated from a surface of the base material into an inside of the base material and then cured, and forming a particle layer containing the particles by the particles remaining on the surface of the base material without being impregnated into the inside of the base material.

DESCRIPTION OF EMBODIMENTS

Figure 1:
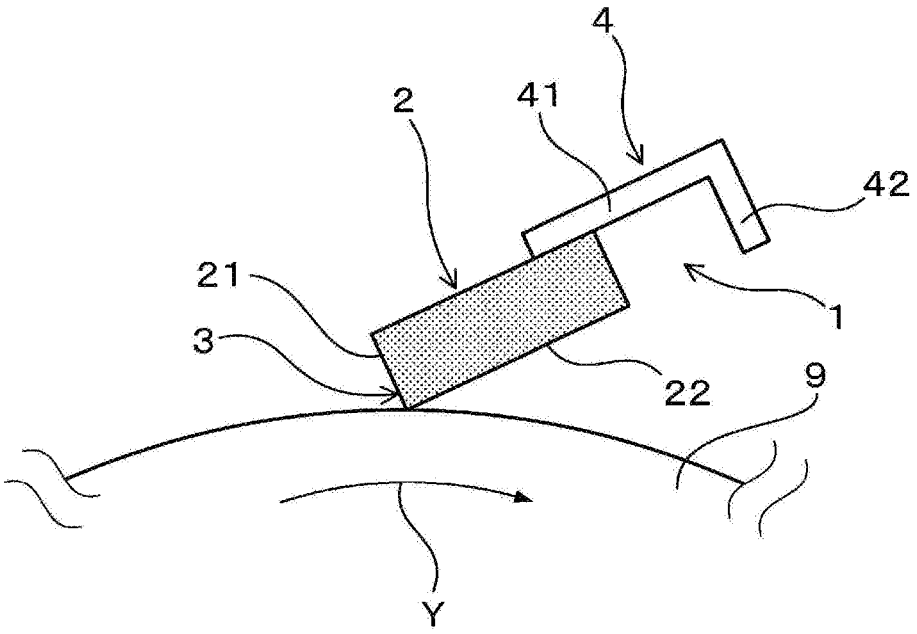
FIG. 1 is an explanatory view schematically illustrating an example of a state in which a cleaning blade of Example 1 is being used.

The cleaning blade has the above-described configurations. In the above-described cleaning blade, the surface of the base material is configured to have low friction due to the impregnated layer containing the polyurethane of the base material and the acrylic cured product. Also, when the surface of the edge comes into sliding contact with a mating member, the particles of the particle layer disposed on the surface of the base material configured to have low friction come into contact with the mating member prior to the surface of the base material. Therefore, a contact area with respect to the mating member decreases. As a result, scraping of the surface of the impregnated layer due to the friction caused by sliding contact with the mating member becomes slow, and thereby the low friction effect of the impregnated layer tends to be exhibited over a long period of time.

However, the above-described operation and effects are exhibited when an average particle diameter of the particles of the particle layer, a thickness of the impregnated layer, and an area ratio of the particle layer to the impregnated layer are within the specified ranges described above. In a case in which an average particle diameter of the particles of the particle layer is within the above-described specified range, when a thickness of the impregnated layer is less than the above-described lower limit value, a particle holding force decreases, falling off of the particles becomes faster, and thus chipping resistance cannot be enhanced. On the other hand, when a thickness of the impregnated layer is greater than the above-described upper limit, surface hardness of the edge becomes excessive, flexibility of the edge decreases, and stress applied to the particles due to sliding contact with the mating member cannot be released, falling off of the particles becomes faster, and thus the chipping resistance cannot be enhanced. Further, when the area ratio of the particle layer to the impregnated layer is outside the above-described range, the chipping resistance cannot be enhanced.

Therefore, according to the above-described cleaning blade, the chipping resistance can be enhanced compared to a cleaning blade having an edge having only the impregnated layer.

Also, according to the method of manufacturing the cleaning blade, it is possible to manufacture a cleaning blade in which the chipping resistance can be enhanced.

The above-described cleaning blade will be described.

The above-described cleaning blade is used for removing residual toner remaining on a surface of a mating member in an electrophotographic apparatus. As the electrophotographic apparatus, specifically, image forming devices such as a copying machine, a printer, a facsimile, a multi-function peripheral, and an on-demand printing machine which employ an electrophotographic method using a charged image can be exemplified. Also, as the mating member, an image carrier or an intermediate transfer belt of a photoreceptor drum or the like, a charging roller, or the like can be exemplified. Further, after a toner image carried on the image carrier is primarily transferred to the intermediate transfer belt, the intermediate transfer belt secondarily transfers the toner image from the belt to a transfer material such as paper.

The above-described cleaning blade includes a blade part made of polyurethane having an edge configured to be brought into sliding contact with a mating member. The blade part can have, for example, a plate shape. Specifically, the edge can include a ridge line configured by an intersection of a first blade surface and a second blade surface adjacent to the first blade surface. More specifically, the above-described cleaning blade can be used by bringing the ridge line of the edge into contact with the mating member. In this case, both the first blade surface and the second blade surface are disposed to face the mating member side at the time of use. When the blade part has a plate shape, the first blade surface can be referred to as a front end surface of the blade part and the second blade surface can be referred to as one plate surface of the blade part.

The edge includes a base material containing polyurethane, an impregnated layer, and a particle layer. In addition to the polyurethane, the base material can contain known additives of various types used in the field of cleaning blades or the like.

The impregnated layer is present from a surface of the base material to an inside of the base material. The impregnated layer contains polyurethane of the base material and an acrylic cured product. Such an impregnated layer can be formed by causing a portion from the surface to the inside the base material containing polyurethane to be impregnated with an acrylic curable material and then cured. The acrylic cured product in the impregnated layer may be mixed with the polyurethane in the blade part, crosslinked with the polyurethane in the blade part, or the like.

As the acrylic cured product, for example, an acrylic resin, a methacrylic resin, or the like can be exemplified. These can be used singly or in combination of two or more. When the acrylic cured product is an acrylic resin or a methacrylic resin, the acrylic cured product can be formed by causing the inside of the base material to be impregnated with an acrylic monomer or a methacrylic monomer and then irradiated with ultraviolet rays. Therefore, according to this configuration, a cleaning blade having excellent manufacturability can be obtained.

From a viewpoint of securing a particle holding forces to inhibit falling off of the particles, facilitating enhancement in chipping resistance, or the like, a thickness of the impregnated layer is preferably equal to or greater than 50 nm, more preferably equal to or greater than 75 nm, still more preferably equal to or greater than 100 nm, and yet still more preferably equal to or greater than 150 nm. Also, from a viewpoint of securing flexibility of the edge, inhibiting falling off of the particles by facilitating release of stress applied to the particles due to sliding contact with the mating member, facilitating enhancement of the chipping resistance, or the like, a thickness of the impregnated layer is preferably 800 nm or less, more preferably 700 nm or less, yet more preferably 600 nm or less, still more preferably 500 nm or less, yet still more preferably 450 nm or less, and yet even still more preferably 400 nm or less.

The thickness of the impregnated layer is an average value of each measured value obtained by measuring a cross-sectional thickness of the impregnated layer at three arbitrary positions from a cross-sectional image of the edge observed using a scanning transmission electron microscope (STEM). Further, since the base material of the blade part is polyurethane, a cross section of the blade part including the edge is dyed for 10 minutes with a 10% phosphotungstic acid aqueous solution, and a portion that has hardly been dyed on an inner side of the surface of the base material can be referred to as an impregnated layer. This is because, although the polyurethane of the base material is contained also in the impregnated layer, the acrylic cured product is contained in the impregnated layer. Therefore, this is because there is a difference in dyeing between a portion further inside from the impregnated layer and the impregnated layer.

The particle layer contains a plurality of particles held on the surface of the base material. Further, the particle layer may be in a state in which the particles are not stacked in a layer thickness direction, may be in a state in which the particles are stacked, or may include both states described above. From a viewpoint of facilitating further enhancement of chipping resistance or the like, an average particle diameter of the particles is preferably 5 nm or greater, more preferably 10 nm or greater, and still more preferably 15 nm or greater. Further, from the viewpoint of facilitating further enhancement of chipping resistance or the like, the average particle diameter of the particles is preferably 90 nm or less, more preferably 80 nm or less, yet more preferably 70 nm or less, still more preferably 60 nm or less, yet still more preferably 50 nm or less, and yet even still more preferably 40 nm or less.

The average particle diameter of the particles is an average value of the diameters of the particles obtained by arbitrarily selecting 10 particles and measuring for each of the selected particles from a cross-sectional image of the edge observed using a scanning transmission electron microscope (STEM).

Also, the particle layer can also contain particle aggregates in which particles are aggregated. That is, the particle layer may contain single particles, particle aggregates, or both. The particle aggregates can be formed, for example, by particles adjacent to each other in a layer surface direction being brought into contact with each other. When the particle layer has a configuration in which particle aggregates are included, further enhancement of the chipping resistance is facilitated. Specifically, from a viewpoint of facilitating further enhancement of the chipping resistance or the like, the number of aggregates contained in the particle layer is preferably 10 or less, more preferably 7 or less, and still more preferably 5 or less. Also, from a viewpoint of toner scraping properties or the like, the number of particle aggregates is preferably 2 or greater, and more preferably 3 or greater. Further, from the viewpoint of facilitating further enhancement of the chipping resistance or the like, the particle aggregates are preferably not stacked in a thickness direction of the particle layer. Also, the particle layer can contain particles whose end surfaces on the base material surface side in a particle circumferential surface are held on the surface of the base material by some of the acrylic cured product.

A thickness of the particle layer can be, for example, 3 nm or greater and 200 nm or less. From a viewpoint of reliably ensuring inhibition of contact of the mating member with the surface of the base material or the like, the thickness of the particle layer is preferably 5 nm or greater, more preferably 10 nm or greater, and still more preferably 15 nm or greater. Further, from a viewpoint of causing the particles not to fall off easily, the thickness of the particle layer is preferably 180 nm or less, more preferably 150 nm or less, yet more preferably 130 nm or less, still more preferably 100 nm or less, yet still more preferably 50 nm or less, yet even still more preferably less than 50 nm, and most preferably 45 nm or less.

The thickness of the particle layer is an average value of each measured value obtained by measuring a cross-sectional thickness of the particle layer at 10 arbitrary positions from a cross section (cross section perpendicular to the surface of the base material) of the edge observed using a scanning transmission electron microscope (STEM).

Specifically, as the particles, for example, carbon particles (such as carbon black), metal particles (such as gold particles, platinum particles, silver particles, or copper particles), oxide particles (such as iron oxide particles, zinc oxide particles, or silica particles), nitride particles (such as silicon nitride particles or aluminum nitride particles), polymer particles (such as polystyrene particles or acrylic resin particles), or the like can be exemplified. These can be used singly or in combination of two or more. In a case in which the particles are silica particles, by using silica particles that are generated in-situ in a solvent (in-situ particles) for a preparation of an impregnating solution used for forming the impregnated layer, a particle layer can be uniformly formed on the surface of the base material even with nanosized particles as described above while avoiding dispersion defects that tend to occur in dried particles. Therefore, a cleaning blade in which enhancing the chipping resistance more reliably is facilitated can be obtained.

Any of the above-described particles may be subjected to a surface treatment. As the surface treatment, specifically, a coating treatment with a resin, a plasma treatment, a coupling treatment, an ultraviolet (UV) treatment, or the like can be exemplified. These can be used singly or in combination of two or more. Among them, when surfaces of the particles are coated with an acrylic resin or a methacrylic resin, adhesion to the impregnated layer is enhanced and thus inhibition of falling off of the particles due to stress applied to the particles caused by sliding contact with the mating member is facilitated. Therefore, according to this configuration, enhancement of the chipping resistance is further facilitated. Further, the entire surface of the particles may be coated with an acrylic resin or the like, or some of the surface of the particles may not be coated with the acrylic resin or the like and the surface of the particles may be partially exposed. Preferably, the former is preferable from a viewpoint of enhancement in adhesion to the impregnated layer or the like. From the viewpoint of enhancing the chipping resistance more reliably or the like, silica particles, silica particles whose surfaces are coated with the above-described acrylic resin or the like, or the like can be suitably selected as the particles. These can be used singly or in combination of two or more.

In the edge, an area ratio of the particle layer to the impregnated layer is 5% or higher and 30% or less in a cross-sectional view perpendicular to the surface of the base material. When the area ratio of the particle layer to the impregnated layer is outside the above-described range, the chipping resistance cannot be enhanced. From a viewpoint of inhibiting falling off of the particles, facilitating enhancement of the chipping resistance, or the like, the area ratio of the particle layer to the impregnated layer can be 6% or higher, preferably 7.5% or higher, more preferably 10% or higher, and still more preferably 15% or higher. Further, from a viewpoint of securing flexibility of the edge, inhibiting falling off of the particles by facilitating release of stress applied to the particles due to sliding contact with the mating member, facilitating enhancement of the chipping resistance, or the like, the area ratio of the particle layer to the impregnated layer can be 29% or less, preferably 27.5% or less, and more preferably 25% or less.

The area ratio of the particle layer to the impregnated layer can be obtained by acquiring a cross section (cross section perpendicular to the surface of the base material) image of the edge using a scanning transmission electron microscope (STEM), obtaining an area of the impregnated layer and an area of the particle layer with respect to the cross-sectional image, and calculating from an expression of 100×(the area of the particle layer)/(the area of the impregnated layer).

A method of manufacturing the above-described cleaning blade (hereinafter, this may also be referred to as a "present manufacturing method") will be described.

In the present manufacturing method, an impregnating solution is applied onto the surface of the base material containing polyurethane. Also, since the base material is as described above in the cleaning blade, description thereof will be omitted.

The impregnating solution contains an acrylic curable material and particles. As the acrylic curable material, for example, a photocurable monomer such as an ultraviolet curable monomer or the like can be exemplified. Specifically, as the photocurable monomer, an acrylic monomer, a methacrylic monomer, or the like which is an ultraviolet curable monomer can be exemplified. These can be used singly or in combination of two or more.

On the other hand, specifically, for example, the above-described particles can be exemplified as the particles. These can be used singly or in combination of two or more.

The particles contained in the impregnating solution can be in-situ particles. The impregnating solution containing the in-situ particles can be prepared, for example, by mixing an acrylic curable material and a particle-containing liquid containing in-situ generated particles in a solvent into a solvent, or the like. When the curable material is a photocurable monomer, the impregnating solution can further contain a photoinitiator or the like. It is preferable that the in-situ particles be in-situ silica particles.

When the impregnating solution is applied, it need only be possible to apply the impregnating solution such that a surface of the edge of the blade part is included. As an application method, application methods of various types such as a dipping method, a brush application method, a spray method, or the like can be applied, for example. Further, application conditions such as a solid content of the above-described impregnating solution, an application amount, an application time, or the like can be adjusted so that a thickness of the impregnated layer is 30 nm or greater and less than 1000 nm.

In the present manufacturing method, the acrylic curable material impregnated from the surface of the base material to the inside of the base material by the above-described application is cured. Thereby, the impregnated layer containing the polyurethane of the base material and the acrylic cured product is formed from the surface of the base material to the inside of the base material.

In the present manufacturing method, particles are contained in the impregnating solution. Therefore, in the present manufacturing method, although the acrylic curable material in the impregnating solution is selectively impregnated into the inside of the base material, the particles remain on the surface of the base material without being impregnated into the inside of the base material. In the present manufacturing method, the particle layer is formed by the particles remaining on the surface of the base material. Specifically, in the present manufacturing method, after a monomer component of the impregnating solution is impregnated into the inside of the base material, some of the monomer component that has wet outer circumferential surfaces of the particles is cured, and thereby the particles can be held on the surface of the base material. In this case, the particles can be held on the surface of the base material utilizing a very small amount of the monomer component.

Further, each of the above-described configurations can be arbitrarily combined as necessary in order to obtain each of the above-described operations and effects, or the like.

EXAMPLES

Hereinafter, cleaning blades of examples will be described with reference to the drawings.

Example 1

Figure 2:
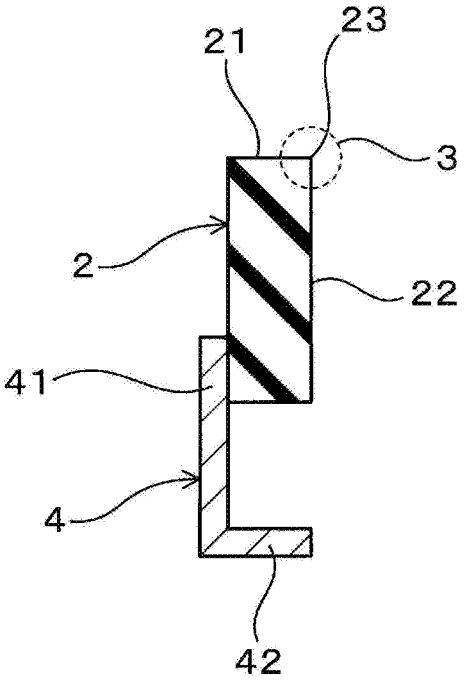
FIG. 2 is a view schematically illustrating a cross section of the cleaning blade of Example 1.
Figure 3:
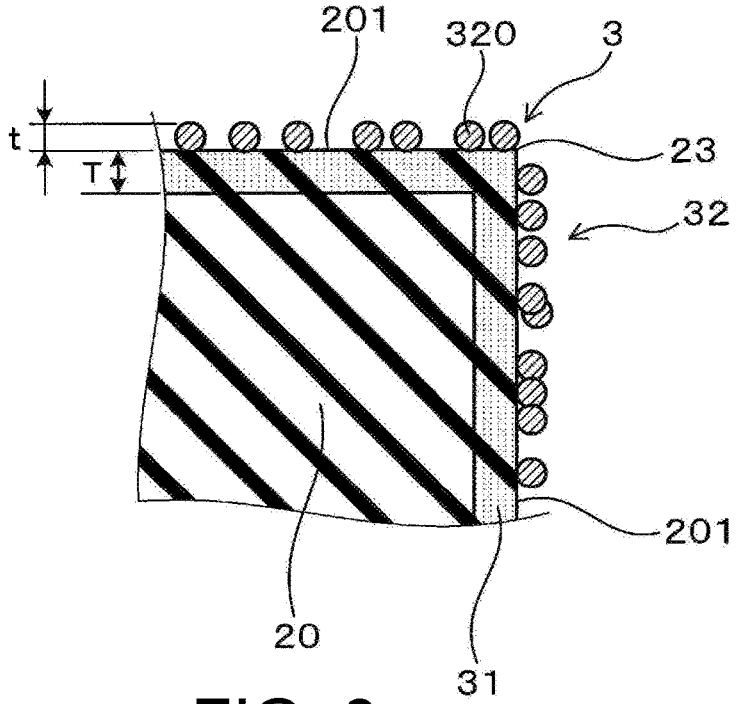
FIG. 3 is an explanatory view schematically illustrating an enlarged cross section of an edge of the cleaning blade of Example 1 illustrated in FIG. 2.

A cleaning blade of Example 1 will be described with reference to FIGS. 1 to 3. As illustrated in FIGS. 1 to 3, a cleaning blade 1 of the present example is a cleaning blade used for removing residual toner (not illustrated, including not only toner but also additives other than the toner) remaining on a surface of a mating member 9 in an electrophotographic apparatus. In the present example, the mating member 9 is specifically a photoreceptor drum. Also, the photoreceptor drum rotates in a direction of an arrow Y illustrated in FIG. 1.

The cleaning blade 1 includes a blade part 2 made of polyurethane including an edge 3 configured to be brought into sliding contact with the mating member 9. In the present example, the polyurethane is a non-foamed polyurethane rubber. Further, in each drawing, an example in which the blade part 2 has a long plate shape is illustrated. Specifically, the cleaning blade 1 in the present example further includes a support body 4 including a plate-shaped part 41 and an attachment part 42 integrally connected to the plate-shaped part 41. The blade part 2 is joined to one plate surface of the plate-shaped part 41 of the support body 4. Further, although not illustrated, in the cleaning blade 1, a front end portion of the plate-shaped part 41 of the support body 4 may be embedded in a rear end portion of the blade part 2.

As illustrated in FIG. 3, the edge 3 includes a base material 20 containing polyurethane, an impregnated layer 31 that is present in a certain region from a surface 201 of the base material 20 to the inside of the base material 20, and a particle layer 32 containing particles 320 held on the surface 201 of the base material 20. The impregnated layer 31 contains polyurethane forming the base material 20 and an acrylic cured product. In the present example, the acrylic cured product is at least one selected from a group consisting of an acrylic resin and a methacrylic resin. Further, the particles are silica particles.

In the cleaning blade 1, an average particle diameter of the particles is set within a range of 3 nm or greater and 100 nm or less. Also, a thickness T of the impregnated layer 31 is set within a range of 30 nm or greater and less than 1000 nm. Further, a thickness t of the particle layer 32 is set within a range of 3 nm or greater and 200 nm or less. Also, in the edge 3, an area ratio of the particle layer 32 to the impregnated layer 31 is set to 5% or higher and 30% or less in a cross-sectional view perpendicular to the surface of the base material 20.

In the present example, the edge 3 includes an ridge line 23 configured by intersection of a first blade surface 21 and a second blade surface 22. Further, the first blade surface 21 is a front end surface of the blade part 2 and the second blade surface 22 is one plate surface of the blade part 2. Both the first blade surface 21 and the second blade surface 22 are disposed to face the mating member 9 side when used.

Also, in the present example, although not illustrated in FIG. 2, specifically, the impregnated layer 31 is present in an entire planar direction of the first blade surface 21 with the ridge line 23 as a starting point. On the other hand, the impregnated layer 31 is present up to somewhere in a range of ½ or less in a planar direction of the second blade surface 22 with the ridge line 23 as the starting point. The particle layer 32 is also present in the same range as in the impregnated layer 31. That is, in the present example, in order to enhance application properties of the impregnating solution at the time of manufacture, the impregnated layer 31 extends also to the inside of the base material 20 on an outer side of the edge 3. Further, the particle layer 32 extends also to the surface of the base material 20 on the outer side of the edge 3.

Next, a method of manufacturing the cleaning blade of the present example will be described. The manufacturing method of the present example is a method in which the cleaning blade 1 of the present example can be manufactured.

In the manufacturing method of the present example, the impregnating solution containing an acrylic curable material and particles is applied onto a surface of the base material containing polyurethane. Next, the acrylic curable material is caused to be impregnated from the surface of the base material to the inside of the base material and then cured, and thereby the impregnated layer containing the acrylic cured product formed by curing the acrylic curable material and the polyurethane of the base material is formed. Also, particles remaining on the surface of the base material without being impregnated into the inside of the base material form the particle layer containing the particles.

In the present example, the acrylic curable material is at least one of an acrylic monomer and a methacrylic monomer. Also, the particles contained in the impregnating solution are in-situ silica particles.

Experimental Example

Hereinafter, the above-described cleaning blade and a manufacturing method thereof will be more specifically described using an experimental example.

<Preparation of a Urethane Rubber Composition>

A main agent solution containing a urethane prepolymer was prepared by mixing 44 parts by mass of polybutylene adipate (PBA) ("Nippollan 4010" manufactured by Tosoh Corporation) and 56 parts by mass of 4,4'-diphenylmethane diisocyanate (MDI) ("Millionate MT" manufactured by Tosoh Corporation) which had been vacuum-defoamed at 80° C. for 1 hour and by reacting the mixture at 80° C. for 3 hours in a nitrogen atmosphere. Further, NCO % (mass %) in the main agent solution was 17.0%.

Also, a curing agent solution having a hydroxyl value (OHV) of 210 (KOH mg/g) was prepared by mixing 87 parts by mass of polybutylene adipate (PBA) ("Nippollan 4010" manufactured by Tosoh Corporation), 13 parts by mass of a low-molecular weight polyol obtained by mixing 1,4-butanediol (manufactured by Mitsubishi Chemical Corporation) and trimethylolpropane (manufactured by Koei-Perstorp Co., Ltd.) in a ratio by weight of 6:4, and 0.01 part by mass of triethylenediamine (manufactured by Tosoh Corporation) as a catalyst at 80° C. for 1 hour in a nitrogen atmosphere.

Next, the main agent solution and the curing agent solution prepared above were mixed at a mixing ratio of 94 parts by mass of the curing agent solution with respect to 100 parts by mass of the main agent solution at 60° C. for 3 minutes in a vacuum atmosphere and then sufficiently defoamed. Thereby, the urethane rubber composition was prepared.

<Preparation of an Impregnating Solution>

—Impregnating Solutions (1-1) to (1-7)—

The impregnating solution (1-1) (solid content: 10%) was prepared by mixing 100 parts by mass of pentaerythritol triacrylate ("Aronix M305" manufactured by Toagosei Co., Ltd.) as an acrylic monomer, 5 parts by mass of 2-hydroxy-2-methyl-1-phenylpropan-1-one ("Irgacure 1173" manufactured by BASF) as a radical photopolymerization initiator, 5 parts by mass (in terms of particle mass) of a particle-containing liquid ("Nano Tek SiO-30" manufactured by C.I. Kasei Co., Ltd., containing in-situ silica particles, average particle size: 30 nm), and 990 parts by mass of methyl ethyl ketone. Also, by adjusting an amount of methyl ethyl ketone in the preparation of the impregnating solution (1-1), the impregnating solution (1-2) (solid content 1%), the impregnating solution (1-3) (solid content: 3%), the impregnating solution (1-4) (solid content 5%), the impregnating solution (1-5) (solid content 15%), the impregnating solution (1-6) (solid content 50%), and the impregnating solution (1-7) (solid content 70%) having different amounts of solid content were prepared.

—Impregnating Solution (2)—

The impregnating solution (2) was prepared in the same manner as in the preparation of the impregnating solution (1) except that 5 parts by mass (in terms of particle mass) of a particle-containing liquid ("Nano Tek SiO-10" manufactured by C.I.Kasei Co., Ltd., containing in-situ silica particles, average particle size: 10 nm) and 990 parts by mass of methyl ethyl ketone were mixed.

—Impregnating Solution (3)—

The impregnating solution (3) was prepared in the same manner as in the preparation of the impregnating solution (1) except that 5 parts by mass (in terms of particle mass) of a particle-containing liquid ("Nano Tek SiO-100" manufactured by C.I.Kasei Co., Ltd., containing in-situ silica particles, average particle size: 100 nm) and 990 parts by mass of methyl ethyl ketone were mixed.

—Impregnating Solution (4)—

The impregnating solution (4) was prepared by mixing 100 parts by mass of pentaerythritol triacrylate ("Aronix M305" manufactured by Toagosei Co., Ltd.) as an acrylic monomer, 5 parts by mass of 2-hydroxy-2-methyl-1-phenylpropan-1-one ("Irgacure 1173" manufactured by BASF) as a radical photopolymerization initiator, 5 parts by mass (in terms of particle mass) of particle-containing liquid ("Nano BYK3605" manufactured by BYK Chemie Co., Ltd., containing in-situ silica particles coated with an acrylic resin on the surface, average particle size: 20 nm), and 990 parts by mass of methyl ethyl ketone.

—Impregnating Solution (5)—

The impregnating solution (5) was prepared by mixing 100 parts by mass of pentaerythritol triacrylate ("Aronix M305" manufactured by Toagosei Co., Ltd.) as an acrylic monomer, 5 parts by mass of 2-hydroxy-2-methyl-1-phenylpropan-1-one ("Irgacure 1173" manufactured by BASF) as a radical photopolymerization initiator, 5 parts by mass of carbon black ("SEAST 3" manufactured by Tokai Carbon Co., Ltd., average particle size: 28 nm) as particles, and 990 parts by mass of methyl ethyl ketone.

—Impregnating Solution (6)—

The impregnating solution (6) was prepared in the same manner as in the preparation of the impregnating solution (1) except that 5 parts by mass (in terms of particle mass) of a particle-containing liquid ("Nano Tek SiO-110" manufactured by C.I.Kasei Co., Ltd., containing in-situ silica particles, average particle size: 110 nm) and 990 parts by mass of methyl ethyl ketone were mixed.

—Impregnating Solution (7)—

The impregnating solution (7) was prepared in the same manner as in the preparation of the impregnating solution (1) except that no particle-containing liquid was mixed at all.

—Impregnating Solution (8)—

The impregnating solution (8) was prepared in the same manner as in the preparation of the impregnating solution (1) except that 40 parts by mass (in terms of particle mass) of a particle-containing liquid ("Nano Tek SiO-30" manufactured by C.I.Kasei Co., Ltd., containing in-situ silica particles, average particle size: 30 nm) and 1305 parts by mass of methyl ethyl ketone were mixed.

<Fabrication of a Blade Part Subjected to be Impregnated>

A mold constituted by an upper mold and a lower mold was prepared. By bringing the upper mold and the lower mold close to each other and clamping them, a cavity having a size corresponding to two blade parts in a substantially long plate shape is formed inside the mold. In this cavity, two housing parts facing each other are provided. Each of these housing parts is constituted such that each plate-shaped part of a metallic support body made of a metallic long plate (plate thickness 2 mm) formed to be bent in an L-shaped cross section can be disposed therein.

Next, an epoxy-based adhesive ("Alon Mighty AS-60" manufactured by Toagosei Co., Ltd.) was applied onto one plate surface of the plate-shaped part of the support body.

Next, the support body onto which the adhesive was applied was set in each of the housing parts of the above-described mold and clamped, and then the above-described prepared urethane rubber composition was injected into the cavity and heated at 130° C. for 10 minutes in order to cure the urethane rubber composition. Thereafter, the molded body was taken out from the mold and cut into two pieces to have a predetermined size. As a result, as illustrated in FIGS. 1 and 2, the plate-shaped blade part (blade thickness: 2 mm, blade width: 10 mm) with the polyurethane rubber as the base material was formed on one plate surface of the plate-shaped part of the support body. Further, an adhesive width between the blade part and the support body was set to 2 mm.

<Fabrication of the Cleaning Blade for Each Sample>

In this manner as described above, the blade parts and predetermined impregnating solutions shown in Table 1 were prepared. Next, each ridge line of the blade parts was caused to face a liquid surface of the predetermined impregnating solution shown in Table 1, and each blade part was immersed in the impregnating solution from the ridge line portion. At this time, in fabricating the cleaning blade of the sample 7 and the sample 3C, the blade part was immersed in the impregnating solution from the ridge line portion immediately after subjecting the impregnating solution to be used to an ultrasonic oscillator for 1 minute. Here, an entire front end surface of the blade part and a range from the ridge line to 3 mm in a blade width direction on one plate surface of the blade part were immersed in the impregnating solution. Further, an amount of a solid content of each impregnating solution was adjusted so that a thickness of the impregnated layer became the values shown in Table 1. Thereafter, the blade part was separated from the impregnating solution.

Next, using an ultraviolet irradiator ("UB031-2A/BM" manufactured by Eye Graphics Co., Ltd.), the portion of the surface of the blade part which was subjected to the impregnating treatment was irradiated with ultraviolet rays under irradiation conditions of a distance of 200 mm between an ultraviolet lamp (mercury lamp type) of the ultraviolet irradiator and the ridge line of the blade part, an ultraviolet ray intensity of 100 mW/cm$^2$, and an irradiation time of 30 seconds to cure the impregnating solution. Thereby, the acrylic monomer as the acrylic curable material almost impregnated from the surface of the base material into the inside of the base material was cured to form an impregnated layer containing the acrylic resin and the polyurethane. Also, at the same time as forming the impregnated layer, a particle layer was formed by particles in the impregnating solution remaining on the surface of the base material without being impregnated into the inside of the base material. As described above, the cleaning blade for each sample including the edge having the configuration shown in Table 1 was obtained. Further, thicknesses of the impregnated layer and the particle layer and an average particle diameter of the particles in Table 1 were measured by the above-described measurement method. In the measurement, a cross section of the blade part was dyed with the 10% phosphotungstic acid aqueous solution described above. The area ratio of the particle layer to the impregnated layer in Table 1 was calculated by the method described above.

<Chipping Resistance>

The blade part of the cleaning blade of each sample was assembled so that the ridge line of the edge was in sliding contact with a photoreceptor drum of a laser beam printer available on the market. Then, in an environment of 10%×10% RH, 100,000 sheets were printed using paper of A4 size. After the endurance test described above, a case in which no chipping has occurred at the edge of the blade part was evaluated as "A+" as being excellent in chipping resistance. Also, a case in which chipping has occurred in a range of 1 to nine 9 was evaluated as "A" as being good in chipping resistance. A case in which chipping has occurred in a range of 10 or more and less than 20 was evaluated as "C" as no improvement was observed in chipping resistance. A case in which chipping has occurred more than 20 was evaluated as "D" as no improvement was observed in chipping resistance.

Figure 4:
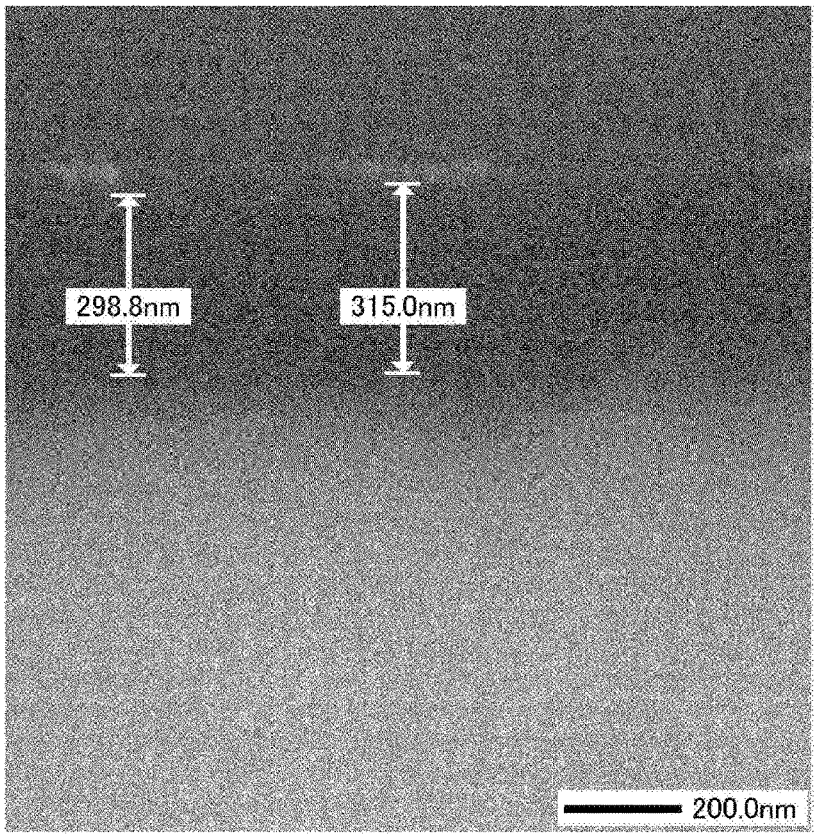
FIG. 4 is a scanning transmission electron microscope (STEM) image of a cross section perpendicular to a surface of a base material of an edge of a sample 6 observed in an experimental example.

Detailed configurations of the cleaning blade of each sample and evaluation results of chipping resistance of the cleaning blade of each sample are summarized in Table 1. Also, FIG. 4 shows a scanning transmission electron microscope (STEM) image (200,000 times) of a cross section perpendicular to the surface of the base material of the edge of the sample 6 as a representative view of the samples 1 to 9.

TABLE 1

| | | | Sample 1 | Sample 2 | Sample 3 | Sample 4 | Sample 5 | Sample 6 | Sample 7 | Sample 8 | Sample 9 |
|---|---|---|---|---|---|---|---|---|---|---|---|
| Types of impregnating solution | | | (1-1) | (5) | (2) | (3) | (1-4) | (1-5) | (1-1) | (8) | (4) |
| Solid content (%) of impregnating solution | | | 10 | 10 | 10 | 10 | 5 | 15 | 10 | 10 | 10 |
| Edge | Particle layer | Average particle diameter (nm) of particle | 30 | 28 | 10 | 100 | 30 | 30 | 30 | 110 | 30 |
| | | Thickness (mm) | 30 | 30 | 10 | 100 | 30 | 30 | 30 | 200 | 200 |
| | | Types of particle | Silica | Carbon black | Silica | Silica | Silica | Silica | Silica | Silica | Silica |
| | Impregnated layer | Thickness (nm) | 300 | 300 | 300 | 300 | 300 | 300 | 300 | 300 | 1000 |
| | | Types of acrylic cured product | Acrylic resin | Acrylic resin | Acrylic resin | Acrylic resin | Acrylic resin | Acrylic resin | Acrylic resin | Acrylic resin | Acrylic resin |

TABLE 1-continued

| | | | | | | | | | |
|---|---|---|---|---|---|---|---|---|---|
| Area ratio (%) of particle layer to impregnated layer | 20 | 20 | 20 | 30 | 5 | 30 | 20 | 30 | 40 |
| Presence or absence of particle aggregate | Present | Present | Present | Present | Present | Present | Absent | Present | Present |
| Chipping resistance | A+ | A | A | A | A | A | A | A | A+ |

| | | | Sample 1C | Sample 2C | Sample 3C | Sample 4C | Sample 5C | Sample 6C |
|---|---|---|---|---|---|---|---|---|
| Types of impregnating solution | | | (6) | (1-7) | (1-2) | (1-3) | (1-6) | (7) |
| Solid content (%) of impregnating solution | | | 10 | 70 | 1 | 3 | 50 | 10 |
| Edge | Particle layer | Average particle diameter (nm) of particle | 30 | 30 | 30 | — | 30 | 20 |
| | | Thickness (nm) | 200 | 30 | 30 | | 200 | 40 |
| | | Types of particle | Silica | Silica | Silica | | Silica | Silica coated with acrylic resin |
| | Impregnated layer | Thickness (mm) | 15 | 100 | 980 | 300 | 300 | 300 |
| | | Types of acrylic cured product | Acrylic resin | Acrylic resin | Acrylic resin | Acrylic resin | Acrylic resin | Acrylic resin |
| | Area ratio (%) of particle layer to impregnated layer | | 100 | 1 | 1 | 90 | — | 20 |
| | Presence or absence of particle aggregate | | Present | Absent | Present | Present | — | Present |
| Chipping resistance | | | C | C | C | C | C | D |

According to Table 1, the following is ascertained. That is, the cleaning blade of the sample 6C does not have a particle layer on the surface of the impregnated layer. Therefore, in the cleaning blade of the sample 6C, a surface of the base material at the edge is in contact with a surface of the photoreceptor drum from the beginning. Accordingly, since a surface of the impregnated layer was scraped from the beginning due to friction caused by the sliding contact with the photoreceptor drum, the low friction effect of the impregnated layer was lost at an early stage during the above-described endurance test, and the chipping resistance was not enhanced in the cleaning blade of the sample 6C.

The cleaning blade of the sample 1C has a particle layer, but an average particle diameter of particles is greater than the upper limit. Therefore, the chipping resistance was not enhanced in the cleaning blade of the sample 1C even though a thickness of the impregnated layer was within the specified range.

In the cleaning blade of the sample 2C, an average particle diameter of particles of the particle layer is within the above-described specified range. However, a thickness of the impregnated layer is greater than the upper limit. Therefore, the chipping resistance was not enhanced in the cleaning blade of the sample 2C. This is because, due to the impregnated layer having a thickness greater than the upper limit being used, surface hardness of the edge became excessive, flexibility of the edge decreased, stress applied to the particles due to sliding contact with the photoreceptor drum could not be released, and thereby falling off of the particles became faster.

In the cleaning blade of the sample 3C, an average particle diameter of particles of the particle layer is within the above specified range. However, a thickness of the impregnated layer is less than the lower limit. Therefore, the chipping resistance was not enhanced in the cleaning blade of the sample 3C. This is because, due to the impregnated layer having a thickness less than the lower limit being used, a particle holding force decreased and falling off of the particles became faster.

In the cleaning blade of the sample 4C, the area ratio of the particle layer to the impregnated layer is less than the lower limit. Therefore, the chipping resistance was not enhanced in the cleaning blade of the sample 4C. This is because, due to the area ratio of the particle layer to the impregnated layer less than the lower limit, falling off of particles thereof could not be easily inhibited.

In the cleaning blade of the sample 5C, the area ratio of the particle layer to the impregnated layer is less than the upper limit. Therefore, the chipping resistance was not enhanced in the cleaning blade of the sample 5C. This is because, due to the area ratio of the particle layer to the impregnated layer higher than the upper limit, flexibility of the edge decreased, stress applied to particles due to sliding contact with the mating member could not be easily released, and thereby falling off of the particles could not be easily inhibited.

In contrast to these, the cleaning blades of the samples 1 to 9 have the configurations described above. In particular, in the cleaning blades of samples 1 to 9, an average particle diameter of the particles of the particle layer, a thickness of the impregnated layer, and an area ratio of the particle layer to the impregnated layer are within the specified ranges described above. Therefore, according to the cleaning blade of the samples 1 to 9, the chipping resistance can be enhanced compared to the cleaning blade of the sample 4C having the edge having only the impregnated layer. This is due to the following reason.

That is, in the cleaning blades of the samples 1 to 9, a surface of the base material is configured to have low friction due to the impregnated layer containing the polyurethane rubber of the base material and the acrylic cured product. Also, when the surface of the edge comes into sliding contact with the photoreceptor drum, the particles of the particle layer disposed on the surface of the base material configured to have low friction come into contact with the photoreceptor drum prior to the surface of the base material. Therefore, a contact area with respect to the photoreceptor drum decreases. As a result, scraping of the surface of the impregnated layer due to friction caused by the sliding contact with the photoreceptor drum becomes slow, and thereby the low friction effect of the impregnated layer tends to be exhibited over a long period of time. As a result, the chipping resistance was enhanced in the cleaning blades of the samples 1 to 9.

Although the examples of the present disclosure have been described above, the present disclosure is not limited to the above-described embodiments and examples, and various modifications are possible within a range not to impair the gist of the present disclosure.

The invention claimed is:

1. A cleaning blade used to remove residual toner remaining on a surface of a mating member in an electrophotographic apparatus, the cleaning blade comprising:

a blade part made of polyurethane including an edge configured to be brought into sliding contact with the mating member, wherein the edge comprising:

a base material containing polyurethane;

an impregnated layer present from a surface of the base material to an inside of the base material and containing the polyurethane of the base material and an acrylic cured product; and a particle layer containing silica particles held on the surface of the base material, the particle layer comprises a particle aggregate, and surfaces of the silica particles are coated with an acrylic resin, and a thickness of the particle layer is 3 nm or greater and 200 nm or less, an average particle diameter of the silica particles is 3 nm or greater and 100 nm or less, a thickness of the impregnated layer is 30 nm or greater and less than 1000 nm, and an area ratio of the particle layer to the impregnated layer is 5% or higher and 30% or less in a cross-sectional view perpendicular to the surface of the base material.

* * * * *